US005658198A

United States Patent [19]

Nagasaka et al.

[11] Patent Number: 5,658,198

[45] Date of Patent: Aug. 19, 1997

[54] PNEUMATIC RUNNING TOY

[75] Inventors: Yoshizou Nagasaka; Katsumi Kakizaki, both of Tokyo, Japan

[73] Assignees: Imagic, Inc.; Tomy Co., Ltd., both of Tokyo, Japan

[21] Appl. No.: 589,472

[22] Filed: Jan. 22, 1996

[30] Foreign Application Priority Data

Jan. 20, 1995 [JP] Japan ..... 7-001909 U

[51] Int. Cl.[6] ..... A63H 29/16

[52] U.S. Cl. ..... 463/64; 273/129 AP; 446/179

[58] Field of Search ..... 463/58, 64; 273/108, 273/119 B, 129 AP; 446/176, 178, 179, 180, 197, 198, 199, 211, 429, 444

[56] References Cited

U.S. PATENT DOCUMENTS 3,367,658 2/1968 Bayha ..... 446/211
3,611,622 10/1971 Lemelson ..... 446/179
3,987,581 10/1976 Brown ..... 463/64
4,209,935 7/1980 Parker .
4,283,053 8/1981 Parker .

FOREIGN PATENT DOCUMENTS 2053008 2/1981 United Kingdom ..... 446/179

*Primary Examiner*—William M. Pierce
*Attorney, Agent, or Firm*—Staas & Halsey

[57] ABSTRACT

A pneumatic toy including a board provided with a runway, a body for running along the runway, an air chamber formed within the board, a blower for supplying air to the air chamber, a plurality of holes associated with the board which communicate with the air chamber and which are inclined relative to the board to direct air against the running body to propel same along the runway.

6 Claims, 9 Drawing Sheets

PNEUMATIC RUNNING TOY

BACKGROUND AND SUMMARY OF INVENTION

The present invention relates to a pneumatic running toy. The use of air pressure to power toy vehicles which traverse track ways is old in the art and one example is schematically depicted in FIG. 14. The track way toy 9 includes a road bed 91 provided at the top thereof with a runway 90 and a vehicle body 92 which moves along the runway 90. Below the runway 90 is provided an air chamber 93 while a carriage 94 is mounted within the air chamber 93. It will be apparent that the carriage 94 and the vehicle 92 are each provided with magnets and thus are attracted to each other. The carriage 94 is moved below the runway 90 by the force of air from the blower 95 being blown against a receiving plate 94*a* located at the rear end of the carriage 94.

In pneumatically running toys such as depicted in FIG. 14, the carriage 94 is essential, since it is the magnetic attraction between the running vehicle 92 and the carriage 94 that causes the vehicle 92 to race along the track way. The vehicle 92 cannot be moved without corresponding movement of the carriage 94 and, accordingly, the air chamber 93 must be sealed and extend around the entire length of the track way, from the starting point to the finishing point of the runway 90. It will also be apparent that since the air chamber 93 must be sealed, it is not possible to have intersecting air chambers 93 and, accordingly, it is not possible for the runway 90 to cross over other runways and the like. It is essential that the air from the blower 95 be confined within the air chamber 93 associated with each vehicle and not be dispersed. Loops in the track way design are not possible since air from the blower 95 would be directed towards the front of the carriage 94 and not the rear end thereof which includes the plate 94*e*.

It is an object of the present invention to provide a simple pneumatic driving mechanism permitting maximum freedom of movement of the vehicle and flexibility in the design of the track way.

In accordance with the principles of the present invention, the track way or running board is provided with a runway and a vehicle or running body for movement therealong. The running board is provided with an air chamber and a blower for supplying air thereto. A number of holes through which air is blown communicate with the air chamber and are inclined in such a direction to impinge on the vehicle and move same along the surface of the runway.

Since the vehicle or running body is adapted to be driven directly by the air blown through the holes, the construction of the entire track way is simplified. In the case where two or more runways are arranged in parallel along the track way and cross each other, the air chambers corresponding to the runways need not be connected to each other. The air chamber is interrupted at those portions in which the runways cross each other, it being understood that the vehicle or running body will move under the force of inertia at those portions where the air chambers are interrupted. It will also be apparent that the air chambers can be arranged in three dimensions promoting additional freedom of movement.

DESCRIPTION OF PREFERRED EMBODIMENT

Figure 1:
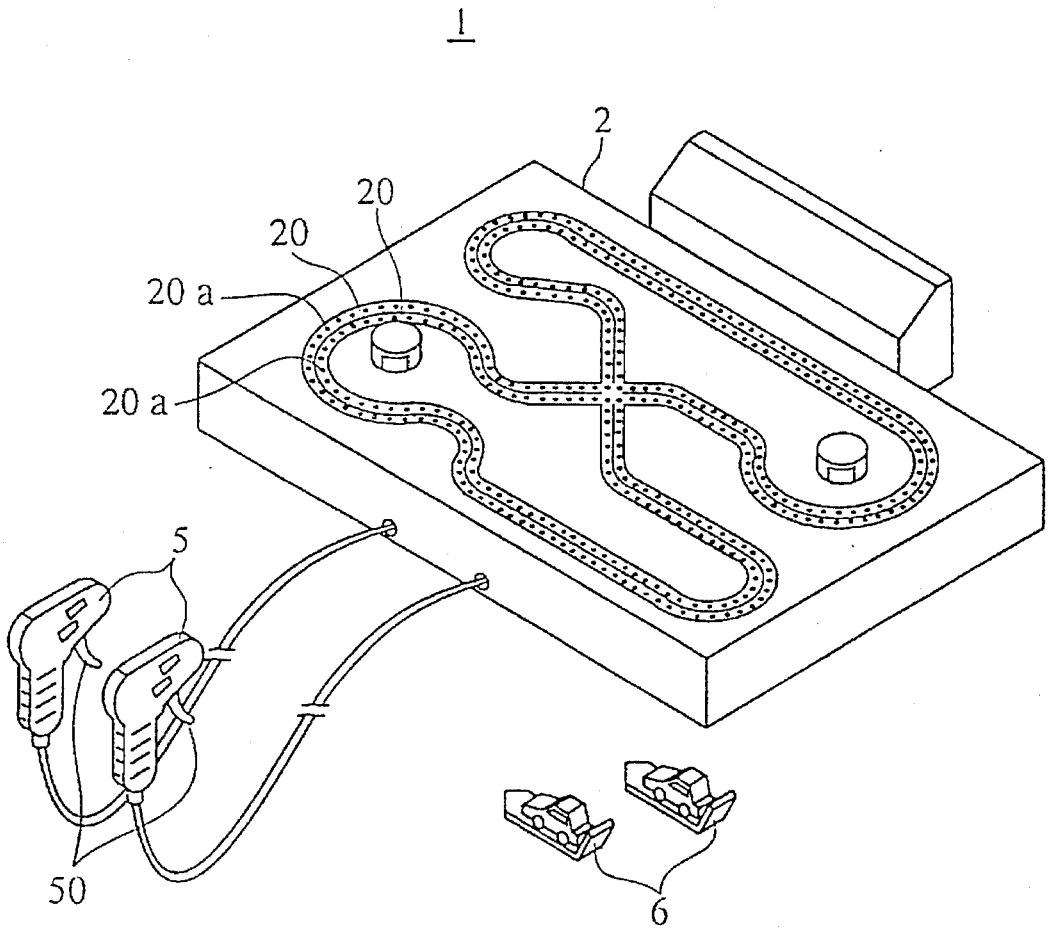
FIG. 1 is a perspective view of the pneumatically operated track way toy of the present invention.
Figure 2:
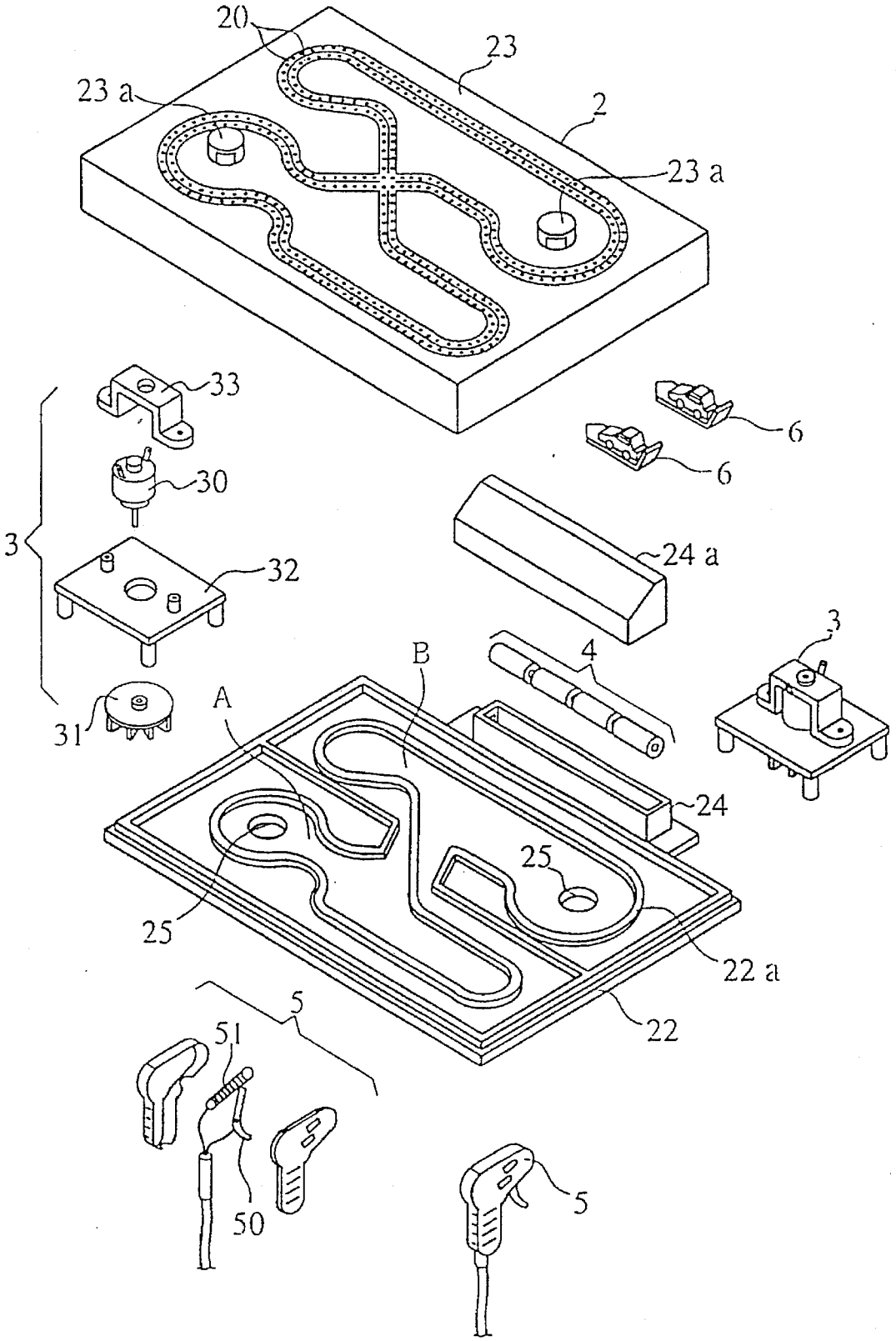
FIG. 2 is an exploded perspective view of the first embodiment.

As seen in FIG. 1, the pneumatic toy track way is generally designated by the reference numeral 1 and consists of a running board or base 2 provided with distinct runways 20 and 21. Blowers 3 are mounted within the running board or base 2, as seen in FIG. 2. There are also provided a battery 4 which provides a source of electrical energy for the blower 3, operating pieces 5 for controlling the operation of the blowers 3 and the running bodies or vehicles 6. As seen in FIG. 1, the top of the running board 2 is provided with a series of holes 20*a* positioned along the runways 20 through which air passes under the influence of the blowers 3.

In practice, the running bodies or vehicles 6 are placed at the starting positions along the runways 20 by each of the two players. An electrical switch is activated and the triggers 50 of the operating pieces 5 are pulled backwards causing the blower 3 associated with each operating piece 5 to operate blowing air from the holes 20*a*. The air moving through the holes 20*a* causes the vehicles to "float" and be driven by the air along the runways 20. The speed with which each of the running bodies 6 moves is proportional to the degree that the corresponding trigger 50 of the operating piece 5 has been depressed. It will be apparent that as a player's vehicle nears the beginning of a curve, the trigger 50 will be released somewhat to slow down the movement of the vehicle 6.

Figure 6:
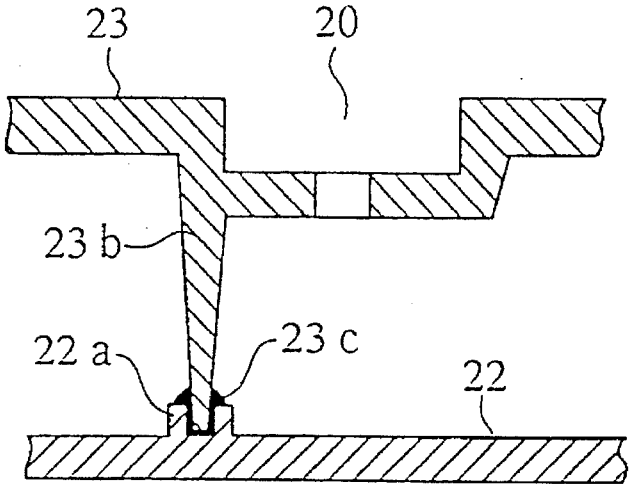
FIG. 6 is a longitudinal sectional view of a portion of the running board of the first embodiment.
Figure 7:
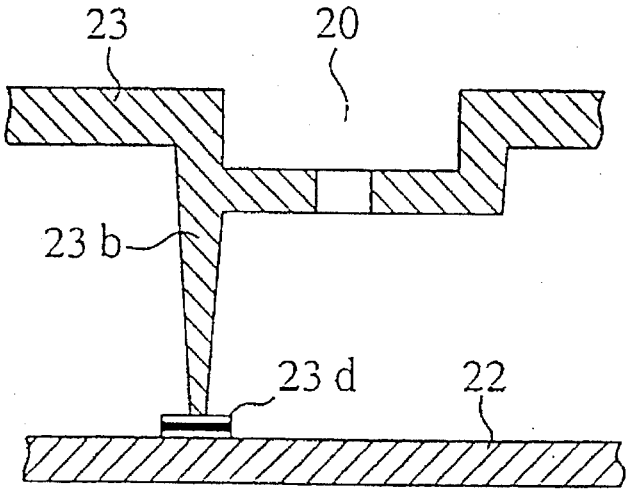
FIG. 7 is a longitudinal sectional view of another portion of the running board of the first embodiment.

As seen in FIG. 2, the base 2 consists of a lower frame 22 and an upper frame 23. The lower frame 22 is partitioned into two regions A and B which correspond to the runways 20 on the top surface of the upper frame 23. When the frames 22 and 23 are assembled, the partition wall 22*a* fits closely against the partition wall 23*b* of the upper frame 23 and is held in place by adhesive 23*c*, as seen in FIG. 6, to thereby define two independent air chambers. The battery box 24 is located near the rear side of the lower frame 22 and holds the batteries 4. It will be apparent that the battery box 24 is provided with a lid 24*a*. The lower frame 22 is also provided with two air inlet ports 25.

Figure 8:
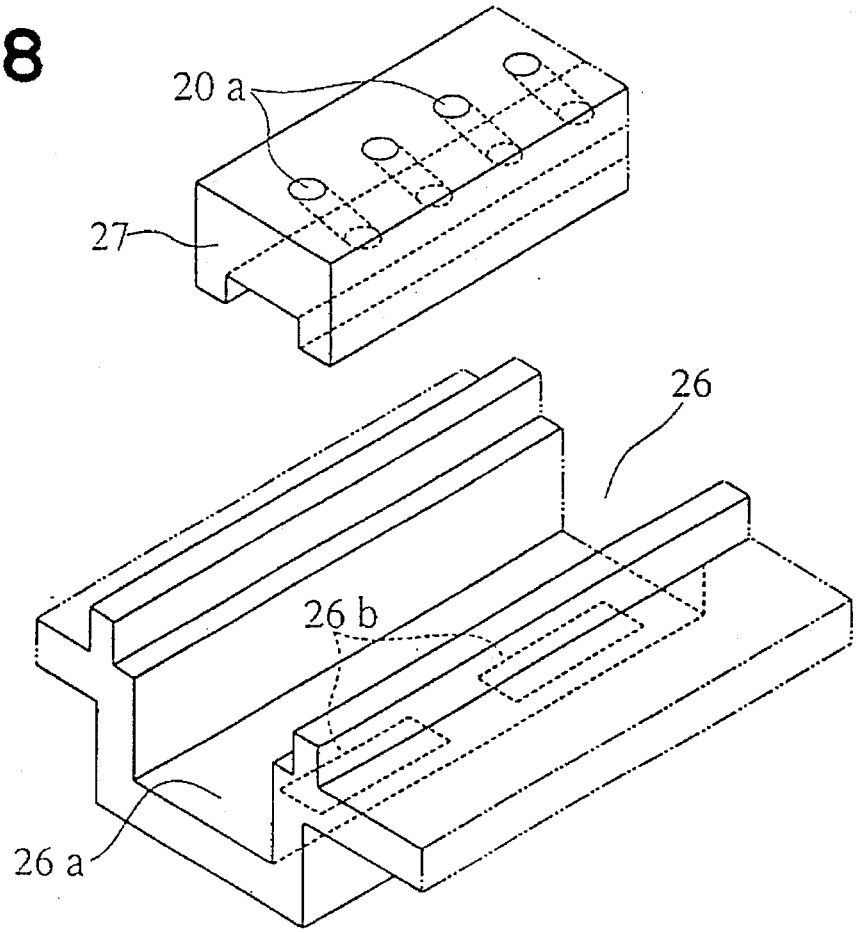
FIG. 8 is a perspective view of the running board of the second embodiment.

The two runways or tracks 20 are arranged in a FIG. 8 and are recessed slightly with respect to the running board or track way surface 2, to thereby guide the moving bodies 6 and prevent same from leaving their respective runways 20. Moreover, the air blowing holes 20*a* disposed within the running board 2 are inclined so as to direct the currents of air passing therethrough to move the vehicles 6. Caps 23*a* cover the head portions of the blowers 3 and are disposed on the upper frame 23. A pressure sensitive adhesive double coated tape 23*d* may be arranged under the partition wall 23*b* of the upper frame 23 as the air chamber is formed.

Each of the blowers 3 includes a motor 30 and an impeller 31 driven thereby. The blower 3 is located between the lower frame 22 and the upper frame 23 with a mounting 32 provided with legs. The impeller 31 of the blower 30 is positioned at the air inlet port 25.

The operating mechanisms 5 are configured as pistols. A variable resistance 51 is located within each of the operating pieces 5 such that the resistance of the driving circuit of the blower 3 can be changed to varying degrees by pulling the trigger 50. The sets of operating pieces 5 and blowers 3 are connected in parallel to the battery 4. Operation of the blower 3 is controlled by the operating piece 5 which controls the amount of air that is blown from the holes 20*a*. A spring (not shown) is conventionally employed in connection with the trigger 20 so as to return the trigger 20 to its initial position.

Figure 3:
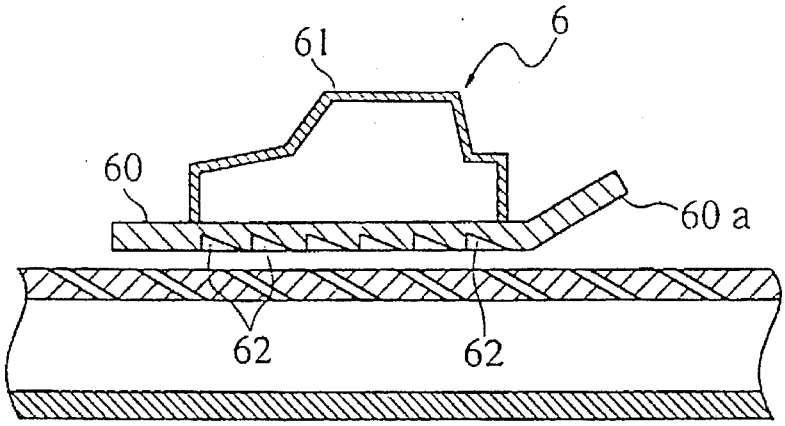
FIG. 3 is a longitudinal sectional view of the vehicle above the running board in the first embodiment.
Figure 4:
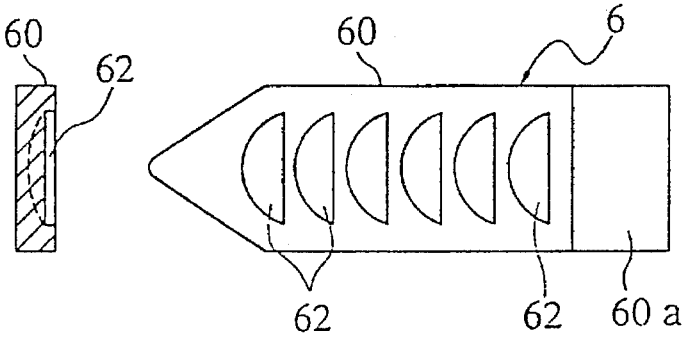
FIG. 4 is an end view of the running toy of the first embodiment.
Figure 5:
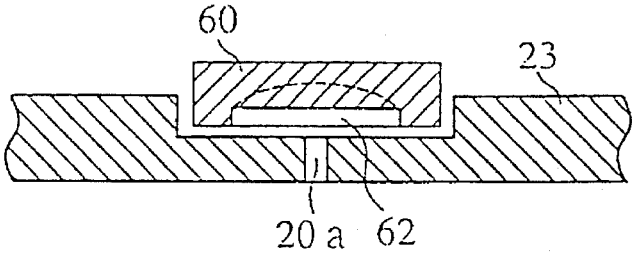
FIG. 5 is a longitudinal sectional view of the running toy of the first embodiment.

Each of the running bodies or vehicles 6, as seen in FIG. 3, consists of a top portion 61 configured as a car supported by a skid plate 60. The skid plate 60 has a wedge-like leading end, whereas the rear portion 60*a* thereof extends upwardly at an oblique angle. The rearward, upward and oblique extension of the rear portion 60*a* assists in the smooth running of each vehicle along the track way. In addition, each of the running bodies or vehicles 6 is provided with six recessed portions 62 formed in the lower side of the skid plate 60 in the longitudinal direction. From FIGS. 4 and 5, it will be apparent that the recess portions 62 are each configured as a hoof and appropriately formed in the skid plate 60 in such a manner that the arc portion of the recess portion 62 is located to the front. The reason for shaping the recess portion 62 as a hoof, and for positioning the arc portion of the recess portion 62 forwardly is to permit the running bodies 6 to be stabilized during movement and to assist in smoothly travelling along curves in the track way. It will be apparent, however, that the recess portions 62 do not have to be shaped as hoofs; it is enough that the recess portions 62 be adapted to receive the air being blown. This can be accomplished using different configurations.

Simplicity is achieved since the running bodies or vehicles 6 are "directly" driven by the currents of air directed from the holes 20*a*. Moreover, although the runways 20 cross each other near the center of the track way, it is not necessary that the air chambers associated with the runways 20 be connected to each other. Even where the runways 20 form a loop, it is not necessary to form the associated air chambers as a loop.

Figure 9:
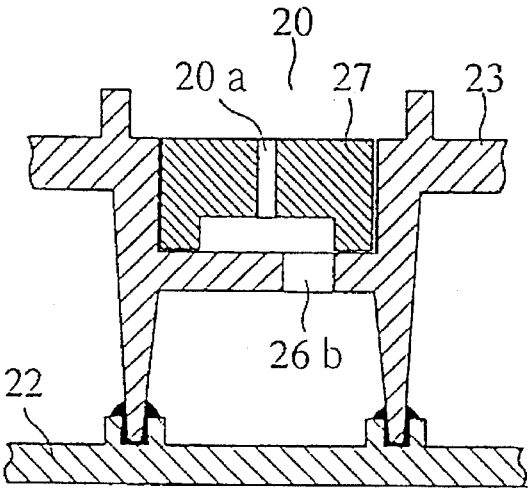
FIG. 9 is a longitudinal sectional view of the running board of the second embodiment.

A second embodiment is illustrated in FIGS. 8 and 9, featuring a groove 26 formed in the running board 2 along the runway 20. On the bottom surface 26*a* of the groove 26 are formed at predetermined distances rectangular openings 26*b* which communicate with the first air chamber disposed above the bottom plate 26*a*. A flexible resin body 27 which functions as the surface of the runway is positioned within the groove 26, as seen in FIG. 9. The second air chamber is formed in the floor plate 26*a*. The air in the lower chamber is lead to the second air chamber from the rectangular opening 26*b* and then blown from the holes 20*a*. In this embodiment, the figure 8-shaped runway is made by simply folding the long flexible resin body 27 as one might draw a picture using the single stroke of a brush. The runway is thus constructed of curved and straight, short, flexible resin bodies 27. A pair of ridges, disposed at positions in which the runway 20 of the running board 2 is interposed, guide the movement of the vehicle 6 by the side walls thereof and prevent the vehicle 6 from leaving the track way.

Figure 10:
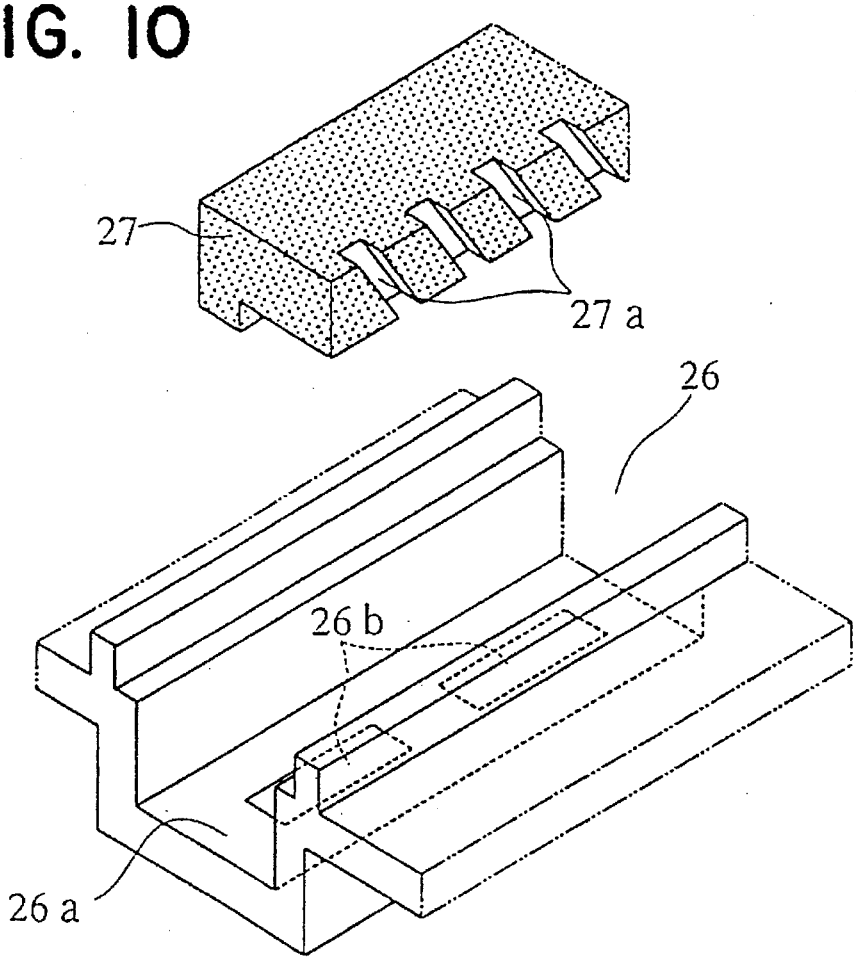
FIG. 10 is a perspective view of the running board of the third embodiment.
Figure 11:
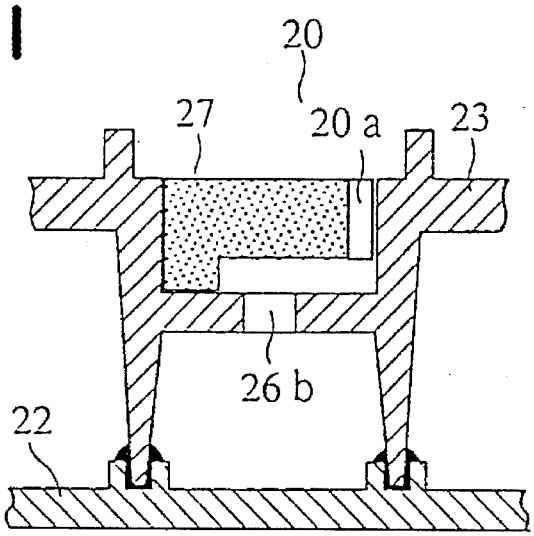
FIG. 11 is a longitudinal sectional view of the running board of the third embodiment.

A third embodiment of the running board 2 is illustrated in FIGS. 10 and 11. In this embodiment, the flexible resin body 27 is formed with an angular portion, and on one side thereof are formed small grooves 27*a* which function as the passageways through which air is blown between the side walls of the groove 27. Since the small grooves 27*a* are formed on one side of the flexible resin body 27, and since the air blowing holes 20*a* are between the side walls of the groove 26, the construction of the air blowing holes 20*a* is greatly simplified.

Figure 12:
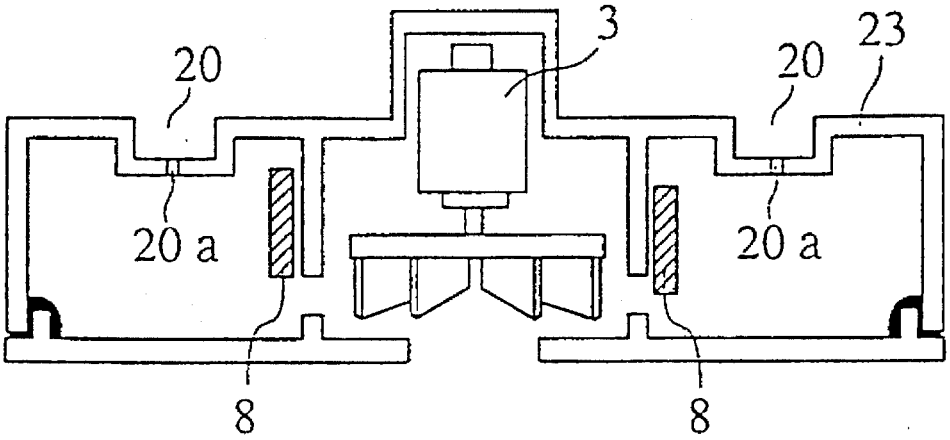
FIG. 12 is a longitudinal sectional view of the running board of a fourth embodiment.

There is depicted in FIG. 12 a fourth embodiment of the present invention. In this embodiment, there is one blower 3. The speed of the running bodies or vehicles 6 is controlled by the amount of air delivered from the single blower 3 by the operation of opening and closing the shutters 8. The shutters 8 are adapted to be opened and closed by the operation of buttons or operating pieces similar to what has previously been disclosed.

Figure 13:
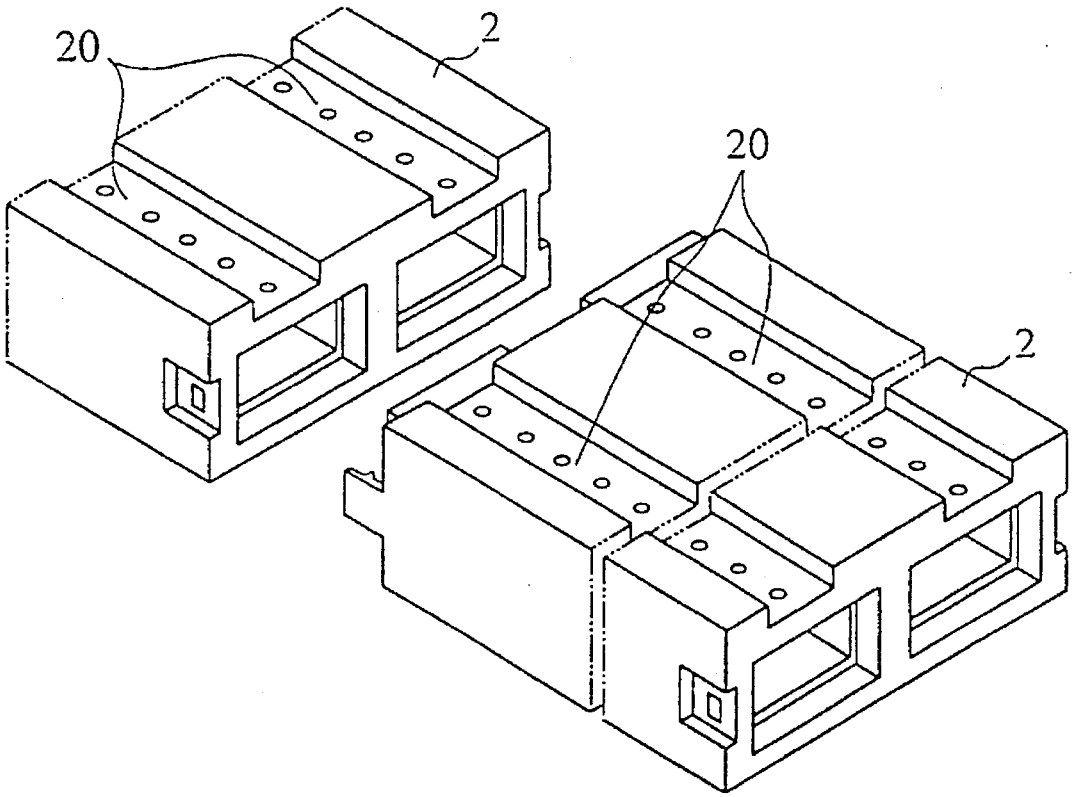
FIG. 13 is a perspective view of the running board of a fifth embodiment.
Figure 14:
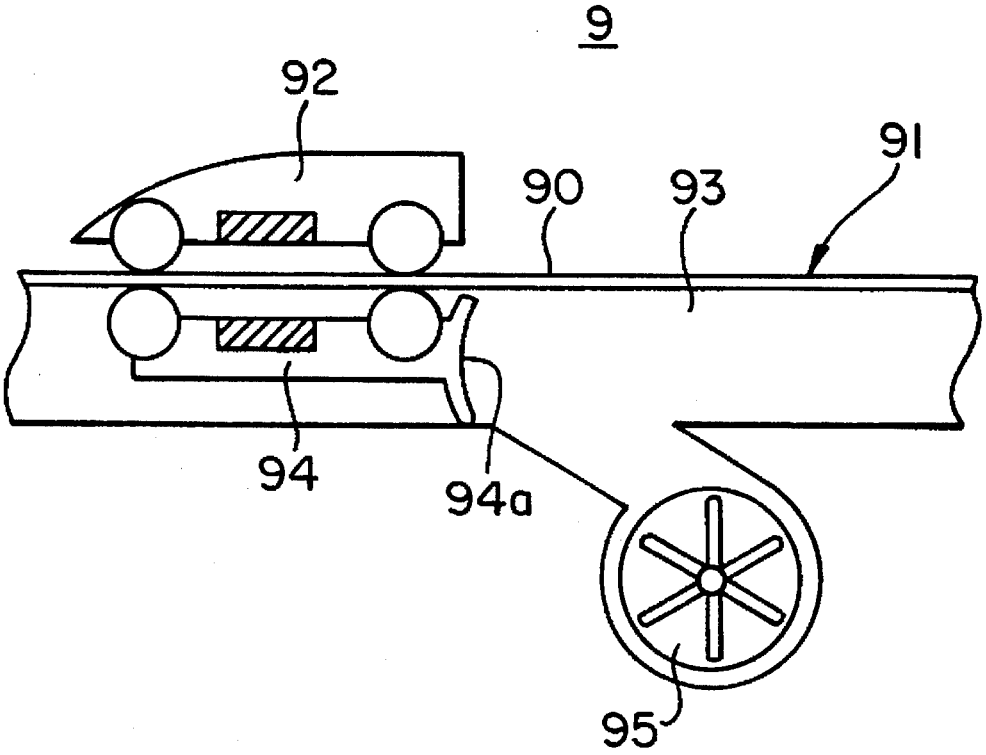
FIG. 14 is a longitudinal view of the running board of a prior art track way toy.

FIG. 13 illustrates a fifth embodiment wherein the running board 2 is constructed of a plurality of track pieces. Courses of varying configuration are easily obtained by combining straight and curved track sections in different combinations.

It will be apparent that the present invention is not limited to the specific embodiments enumerated above. It will be apparent, for example, that although the vehicles of the embodiments disclosed herein are adapted to float along the surface, the vehicles could just as easily be provided with wheels or be constructed to move by sliding action along the track way.

What is claimed is:

1. A pneumatic toy, comprising:

a board provided with a runway, a running body for running along the runway, an air chamber formed in association with the board, a blower for supplying air to the air chamber, a plurality of holes associated with the board which communicate with the air chamber and which are inclined at an angle relative to the board to direct air against the running body to propel same along the runway, the running body being provided with recessed portions for receiving the air directed from the holes, the recessed portions extending upwardly into the running body from a lower surface thereof, the recessed portions being inclined at an angle corresponding to the angle of inclination of the holes, relative to the lower surface of the running body.

2. A pneumatic toy as in claim 1, further including means for controlling the amount of air blown from the holes.

3. A pneumatic toy as in claim 1, wherein the runway is comprised of a groove and a flexible resin body fitted within the groove, the plurality of holes being formed in the flexible resin body.

4. A pneumatic toy as in claim 3, wherein the flexible resin body of the runway is comprised of a plurality of detachable pieces of flexible resin fitted end-to-end within the groove.

5. A pneumatic toy as in claim 1, wherein the running body has a rear surface portion extending upwardly and rearwardly from the lower surface.

6. A pneumatic toy as claimed in claim 1, wherein the running body has a front end which leads the running body when running, the recessed portions extending at an angle from the lower surface, upwardly toward the front end.

* * * * *